US009586423B2

(12) United States Patent
Sasaki et al.

(10) Patent No.: US 9,586,423 B2
(45) Date of Patent: Mar. 7, 2017

(54) TAPE CARTRIDGE AND TAPE FEEDING APPARATUS

(71) Applicant: Seiko Epson Corporation, Tokyo (JP)

(72) Inventors: Taishi Sasaki, Suwa (JP); Kenichi Nakajima, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/777,626

(22) PCT Filed: Mar. 20, 2014

(86) PCT No.: PCT/JP2014/001652

§ 371 (c)(1),
(2) Date: Sep. 16, 2015

(87) PCT Pub. No.: WO2014/148062

PCT Pub. Date: Sep. 25, 2014

(65) Prior Publication Data

US 2016/0271978 A1 Sep. 22, 2016

(30) Foreign Application Priority Data

Mar. 21, 2013 (JP) ..... 2013-058870
Mar. 21, 2013 (JP) ..... 2013-058871
Oct. 28, 2013 (JP) ..... 2013-223583

(51) Int. Cl.
*B41J 2/32* (2006.01)
*B41J 11/66* (2006.01)
(Continued)

(52) U.S. Cl.
CPC ..... *B41J 15/044* (2013.01); *B41J 3/4075* (2013.01)

(58) Field of Classification Search
CPC ..... B41J 3/4075; B41J 15/044
See application file for complete search history.

(56) References Cited

U.S. PATENT DOCUMENTS

2011/0217108 A1 9/2011 Imamura et al.
2012/0027485 A1 2/2012 Suva et al.
2014/0037359 A1* 2/2014 Nakajima ..... B41J 11/663 400/621

FOREIGN PATENT DOCUMENTS

JP 11-314409 11/1999
JP 2006-289988 A 10/2006
JP 2011-178147 A 9/2011

OTHER PUBLICATIONS

Search Report received in International Application No. PCT/JP2014/001652, Jun. 17, 2014.

* cited by examiner

*Primary Examiner* — Julian Huffman
(74) *Attorney, Agent, or Firm* — ALG Intellectual Property, LLC

(57) ABSTRACT

Provided is a tape cartridge or the like that prevents detection target portions from contacting a finger or the like when an exposed area is provided in a cartridge case to cause the detection target portions of a tape-shaped member to be exposed. A tape cartridge includes a label tape 101 having a plurality of label portions 105 and a plurality of detection target portions 109 and a cartridge case and is installed in a tape feeding apparatus that feeds the label tape 101 based on the passage detection of the detection target portions 109 to separate the label portions 105 at a cut spot 112 on the label tape 101 at a cut position P3 outside the cartridge case. The cartridge case has an exposed area in which the respective detection target portions 109 are exposed, and a distance L1 between the cut position P3 and the upstream end of the exposed area is shorter than a distance L2 between a detection tip-end 109*a* of the detection target portion 109 corresponding to any of the label portions 105 and the cut
(Continued)

spot 112 of the label portion 105 adjacent to the said label portion 105 on a paying-out tip-end side.

10 Claims, 14 Drawing Sheets

(51) Int. Cl.
*B41J 15/04* (2006.01)
*B41J 3/407* (2006.01)

TAPE CARTRIDGE AND TAPE FEEDING APPARATUS

TECHNICAL FIELD

The present invention relates to a tape cartridge in which a tape-shaped member is accommodated so as to be capable of being paid out and a tape feeding apparatus that pays out and feeds the tape-shaped member from the installed tape cartridge.

BACKGROUND ART

Conventionally, there has been known a label creation apparatus including: a cartridge in which a tag tape having a plurality of wireless tag circuit elements provided along a tape length direction and a plurality of black marks provided along the tape length direction so as to correspond to the plurality of wireless tag circuit elements are accommodated so as to be capable of being paid out; a cartridge holder in which the cartridge is installed; a cutter unit that cuts off the tag tape at a cut position outside the cartridge; a mark sensor that detects the passage of the respective black marks; and conveyance means for feeding the tag tape based on the passage detection of the black marks corresponding to the wireless tag circuit elements to separate the wireless tag circuit elements at a prescribed cut spot on the tag tape by the cutter unit (see, for example, Patent Document 1).

[Patent Document 1] JP-A-2011-178147

Meanwhile, it is assumed to use a tape-shaped member having a plurality of label portions along its tape length direction instead of the above tag tape. In this case, in order to detect the positions of the respective label portions in a tape feeding direction, it is assumed to provide a plurality of detection target portions projecting in a tape width direction along the tape length direction so as to correspond to the respective label portions at one end in the tape width direction of the tape-shaped member instead of the above black marks and form an exposed area, in which the respective detection target portions are exposed to detect the passage of the detection target portions by a detection portion, in a cartridge case.

However, if the detection target portion corresponding to the n-th label portion is exposed in the exposed area until the next tape feeding is performed in succession to the separation of the label portion (the n−1-th label portion) adjacent to any of the label portions (the n-th label portion from a paying-out tip-end side) on the paying-out tip-end side, there is a likelihood that the detection target portion contacts a user's finger or the like to be folded. If the detection target portion is folded, it gets stuck on the detection portion or the like, which may result in a factor responsible for jamming.

The present invention has an object of providing a tape cartridge and a tape feeding apparatus that prevent detection target portions from contacting a finger or the like when an exposed area is provided in a cartridge case to cause the detection target portions of a tape-shaped member to be exposed.

DISCLOSURE OF THE INVENTION

According to the present invention, there is provided, there is provided a tape cartridge comprising: a tape-shaped member having a plurality of label portions provided along a tape length direction and a plurality of detection target portions provided along the tape length direction so as to correspond to the plurality of label portions on one side thereof in a tape width direction and projecting in the tape width direction; and a cartridge case in which the tape-shaped member is accommodated so as to be capable of being paid out, wherein the tape cartridge is installed in a tape feeding apparatus that feeds the tape-shaped member based on passage detection of the detection target portions corresponding to the label portions to separate the label portions at a prescribed cut spot on the tape-shaped member at a cut position outside the cartridge case, the cartridge case has an exposed area, in which the respective detection target portions are exposed such that passage of the respective detection target portions is detected by the tape feeding apparatus, on a feed path of the tape-shaped member, and a distance between the cut position and an upstream end of the exposed area is shorter than a distance between an end on a paying-out tip-end side of the detection target portion corresponding to any of the label portions and the cut spot of another of the label portions adjacent to the said label portion on the paying-out tip-end side in the tape feeding direction.

According to the present invention, there is provided a tape feeding apparatus comprising: a tape cartridge having a tape-shaped member and a cartridge case in which the tape-shaped member is accommodated so as to be capable of being paid out, the tape-shaped member having a plurality of label portions provided along a tape length direction and a plurality of detection target portions provided along the tape length direction so as to correspond to the plurality of label portions at one end in a tape width direction and projecting in the tape width direction; a cartridge installation portion in which the tape cartridge is installed; a cutting portion that cuts off the tape-shaped member at a cut position outside the cartridge case; a detection portion that detects passage of the respective detection target portions; and a feed portion that feeds the tape-shaped member based on the passage detection of the detection target portions corresponding to the label portions to separate the label portions at a prescribed cut spot on the tape-shaped member by the cutting portion, wherein the cartridge case has an exposed area, in which the respective detection target portions are exposed to be detected by the detection portion, on a feed path of the tape-shaped member, and a distance between the cut position and an upstream end of the exposed area is shorter than a distance between an end on a paying-out tip-end side of the detection target portion corresponding to any of the label portions and the cut spot of another of the label portions adjacent to the said label portion on the paying-out tip-end side in the tape feeding direction.

According to the configuration, in a state in which the label portion (the n−1-th label portion) adjacent to the said label portion (the n-th label portion) on the paying-out tip-end side is separated at the cut spot, the cut spot of the n−1-th label portion aligns with the cut position in the tape feeding direction. Therefore, the end on the paying-out tip-end side of the detection target portion corresponding to the n-th label portion is positioned upstream of the upstream end of the exposed area. Thus, in a state in which the n−1-th label portion is separated, the detection target portion corresponding to the n-th label portion is not exposed in the exposed area. Accordingly, until the next tape feeding is performed in succession to the separation of the n−1-th label portion, the detection target portion corresponding to the n-th label portion can be prevented from contacting a user's finger or the like.

In the above tape cartridge and the tape feeding apparatus, the cartridge case preferably has a cover wall portion that covers an end surface on the one side of the tape-shaped member, the cover wall portion preferably has a projection opening that causes the respective detection target portions to project to the one side, a tape cover portion that covers the respective passing detection target portions is preferably provided at an upstream end in the tape feeding direction of the projection opening, and the exposed area is preferably formed downstream of the tape cover portion in the tape feeding direction.

According to the configuration, since the respective detection target portions projecting from the projection opening are covered with the tape cover portion, they can be prevented from contacting a user's finger or the like.

In this case, in the tape width direction, an end on the one side of the tape cover portion is preferably positioned closer to the other side than an end on the one side of the cover wall portion.

According to the configuration, it becomes possible to dispose another member so as not to interfere with the tape cover portion on the one side of the tape cover portion and at the same position as the end on the one side of the cover wall portion. Accordingly, a degree of flexibility in the arrangement of the members in the tape feeding apparatus can be increased.

In the above tape cartridge, the cartridge case preferably has a slit-shaped tape delivery port, and a detection target passage of the tape delivery port, through which the respective detection target portions pass, preferably have a chamfering portion at a corner on an inner surface side of the cartridge case of an edge thereof.

According to the configuration, the detection target passage has the chamfering portion at the corner on the inner surface side of the edge thereof. Therefore, when the respective detection target portions pass through the detection target passage, the tip ends of the detection target portions can be prevented from getting stuck on the corner. Since the width of the tape delivery port is not required to be increased only with the chamfering portion, a swinging amount of the tape-shaped member delivered from the tape delivery port does not become great in a direction crossing the feeding direction of the tape-shaped member. Therefore, the running performance or the like of the tape-shaped member is not impaired.

In this case, the tape delivery port is preferably formed to have substantially a same width over a whole length thereof.

According to the configuration, the tape delivery port can be formed to be narrow as a whole. Thus, since the swinging amount of the tape delivery port delivered from the tape delivery port can be made smaller in the direction crossing the feeding direction of the tape-shaped member, the running performance of the tape-shaped member can be more satisfactorily obtained.

In this case, the tape delivery port is preferably such that the detection target passage is formed to be wider than other portions thereof.

According to the configuration, when the respective detection target portions pass through the detection target passage, the tip ends of the respective detection target portions can be more effectively prevented from getting stuck on the corner on the inner surface side of the edge thereof.

In this case, the cartridge case preferably has a slit-shaped tape delivery port, and the tape delivery port is preferably such that the detection target passage, through which the respective detection target portions pass, is formed to be wider than other portions thereof.

According to the configuration, the detection target passage of the tape delivery port is formed to be wider than other portions thereof. Therefore, when the respective detection target portions pass through the detection target passage, the tip ends of the respective detection target portions can be prevented from getting stuck on the corner on the inner surface side of the edge. In addition, the detection target passage is formed to be wider, but the whole width of the tape delivery port is not increased. Therefore, the swinging amount of the tape-shaped member delivered from the tape delivery port does not become great, and thus the running performance or the like of the tape-shaped member is not impaired.

BEST MODES FOR CARRYING OUT THE INVENTION

Hereinafter, a description will be given of a label creation apparatus according to an embodiment of the present invention with reference to the accompanying drawings. The label creation apparatus of the embodiment is used in a state of being connected to a print data creation apparatus (for example, a personal computer) in a wired or wireless fashion, acquires print data created and edited by the print data creation apparatus, and performs printing on the respective label portions of a label tape based on the acquired print data.

Figure 1:
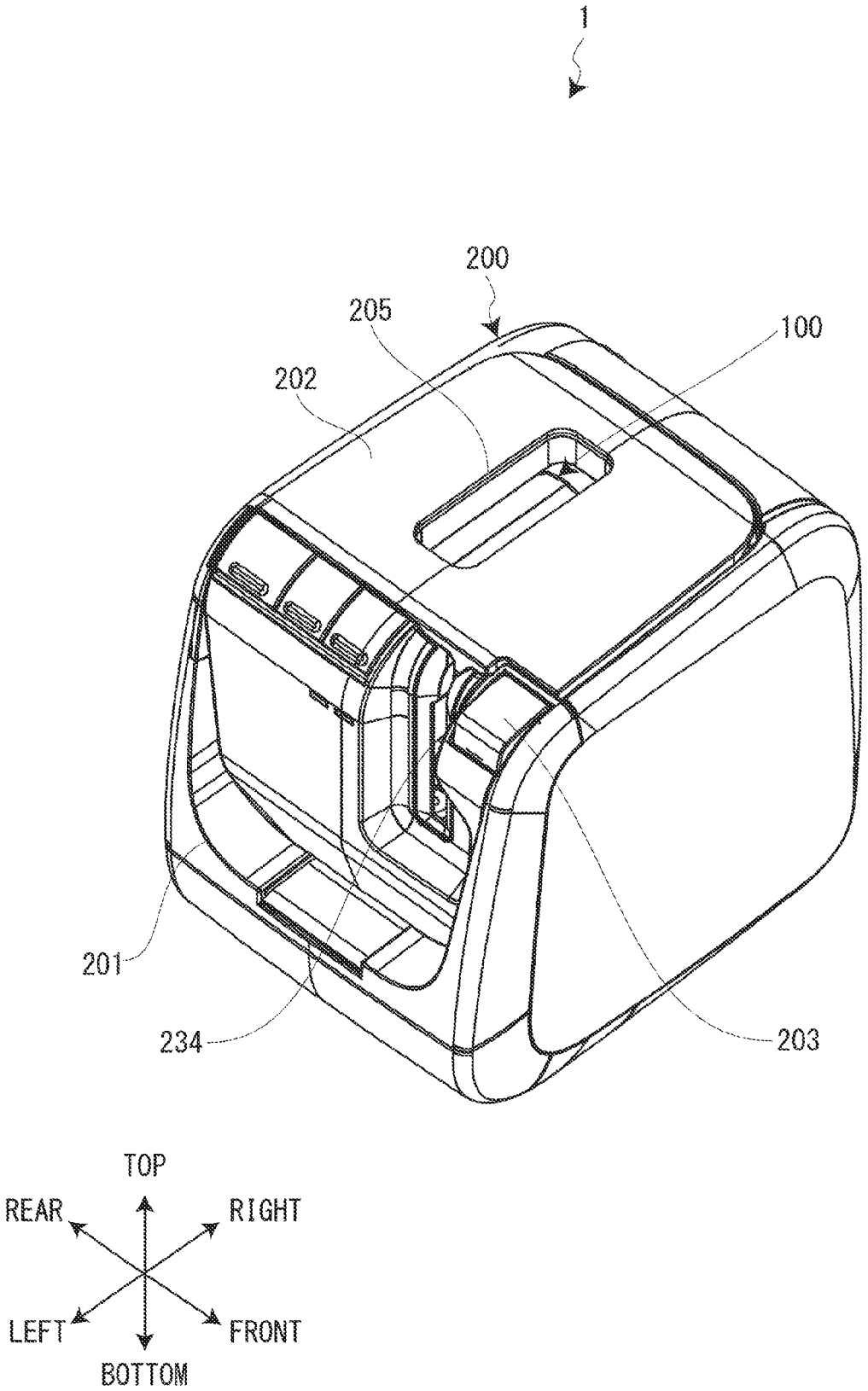
FIG. 1 is a perspective view showing a state in which the cover of a label creation apparatus according to an embodiment of the present invention is closed.
Figure 2:
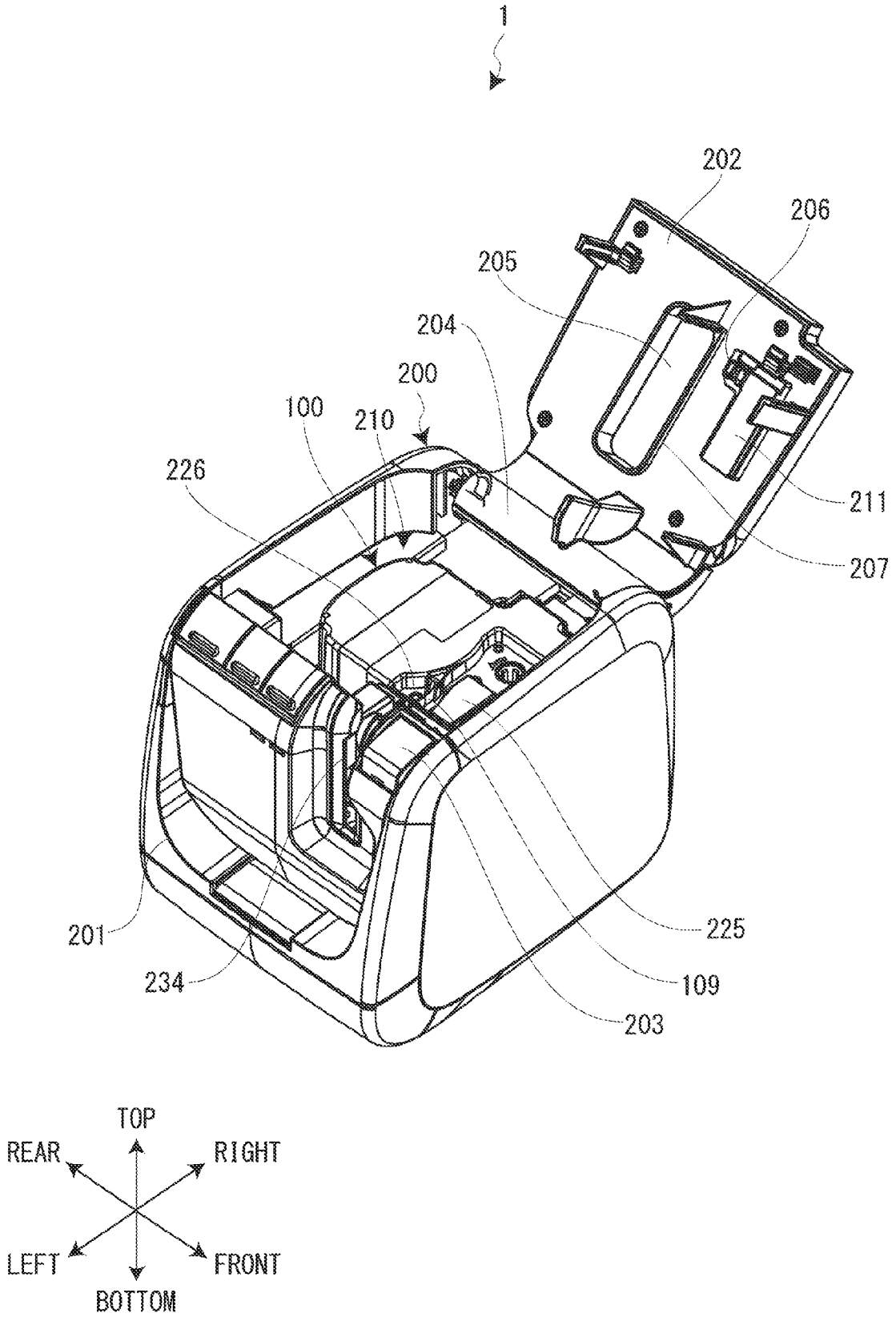
FIG. 2 is a perspective view showing a state in which the cover of the label creation apparatus according to the embodiment of the present invention is opened.
Figure 6:
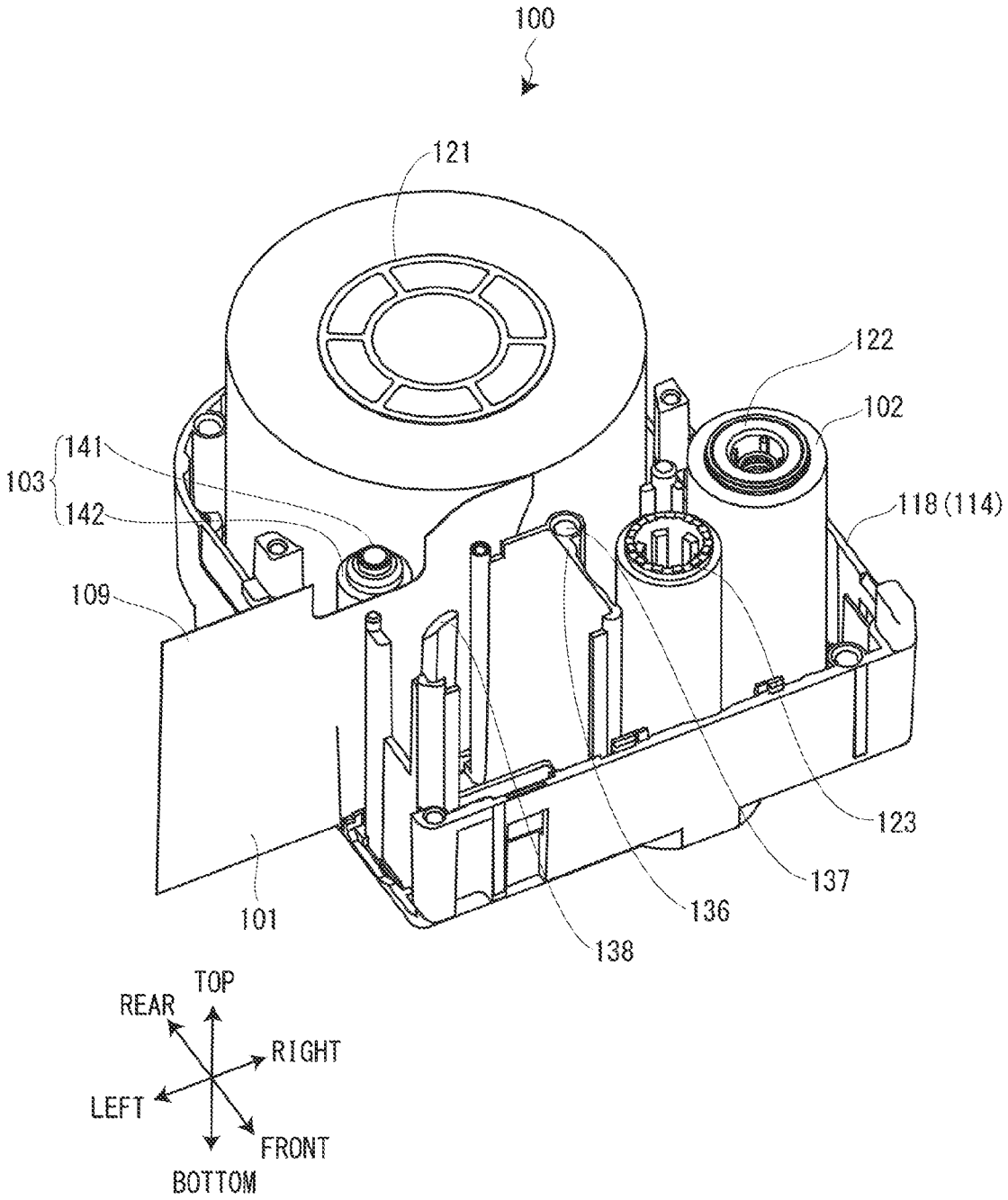
FIG. 6 is a perspective of the tape cartridge with its upper casing removed.

As shown in FIGS. 1 and 2, a label creation apparatus 1 has a tape cartridge 100 and an apparatus main body 200 in which the tape cartridge 100 is freely attachably/detachably installed. The tape cartridge 100 has a label tape 101, an ink ribbon 102, a platen roller 103, and a cartridge case 104 in which the label tape 101, the ink ribbon 102, the platen roller 103 are accommodated (see FIG. 6). The label tape 101 has a plurality of label portions 105 provided along its length direction (see FIG. 3). The label creation apparatus 1 performs printing on the respective label portions 105 based on print data acquired from a print data creation apparatus not shown while paying out and feeding the label tape 101 from the installed tape cartridge 100 and separates the printed respective label portions 105 to create labels printed as desired.

Figure 3:
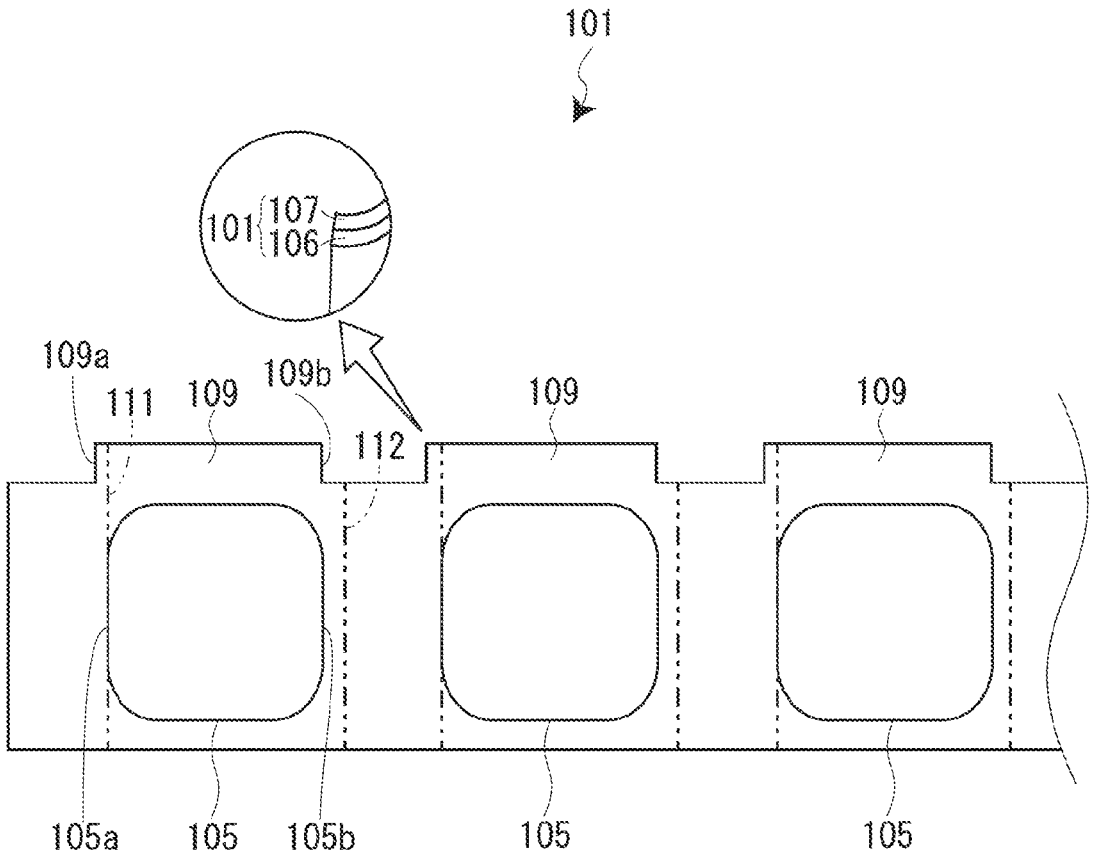
FIG. 3 shows a label tape accommodated in the tape cartridge of the label creation apparatus.
Figure 4A:
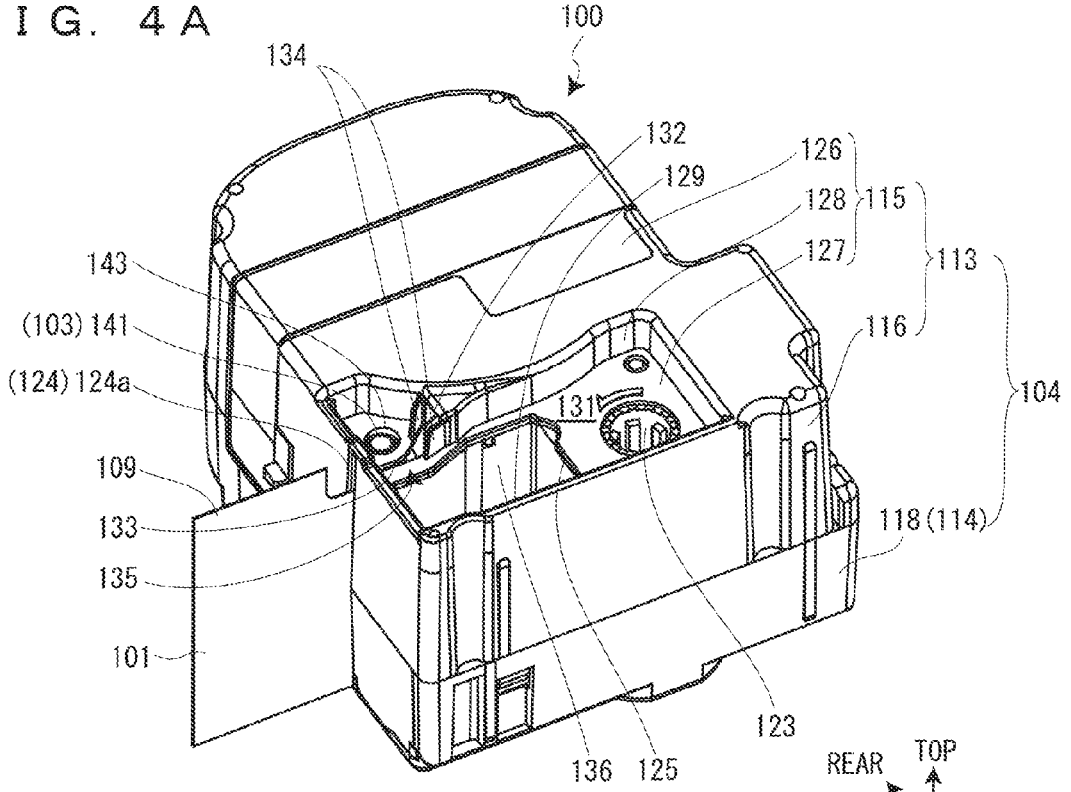
FIG. 4A is a perspective view of the tape cartridge.
Figure 4B:
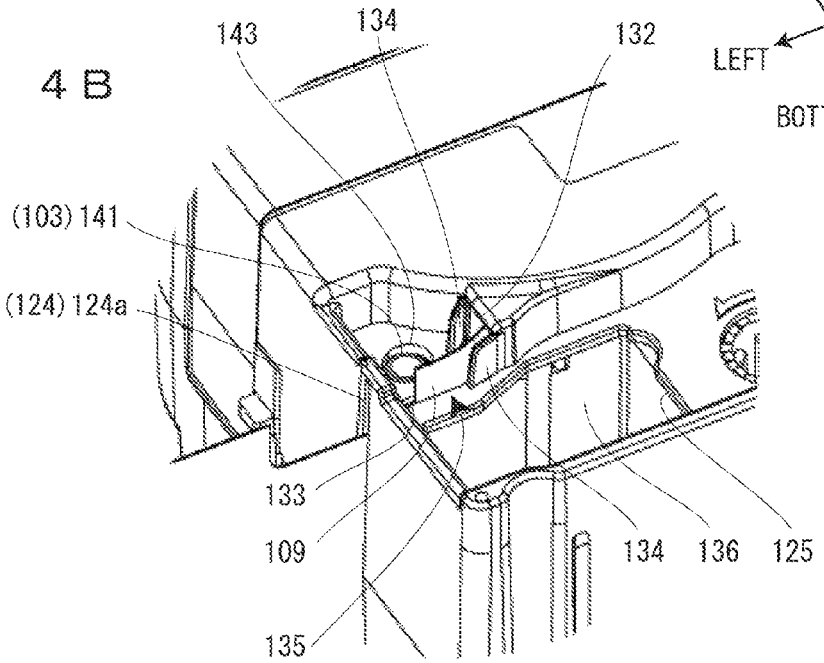
FIG. 4B is a partially-enlarged view of the tape cartridge of FIG. 4A in the vicinity of a platen roller.
Figure 5:
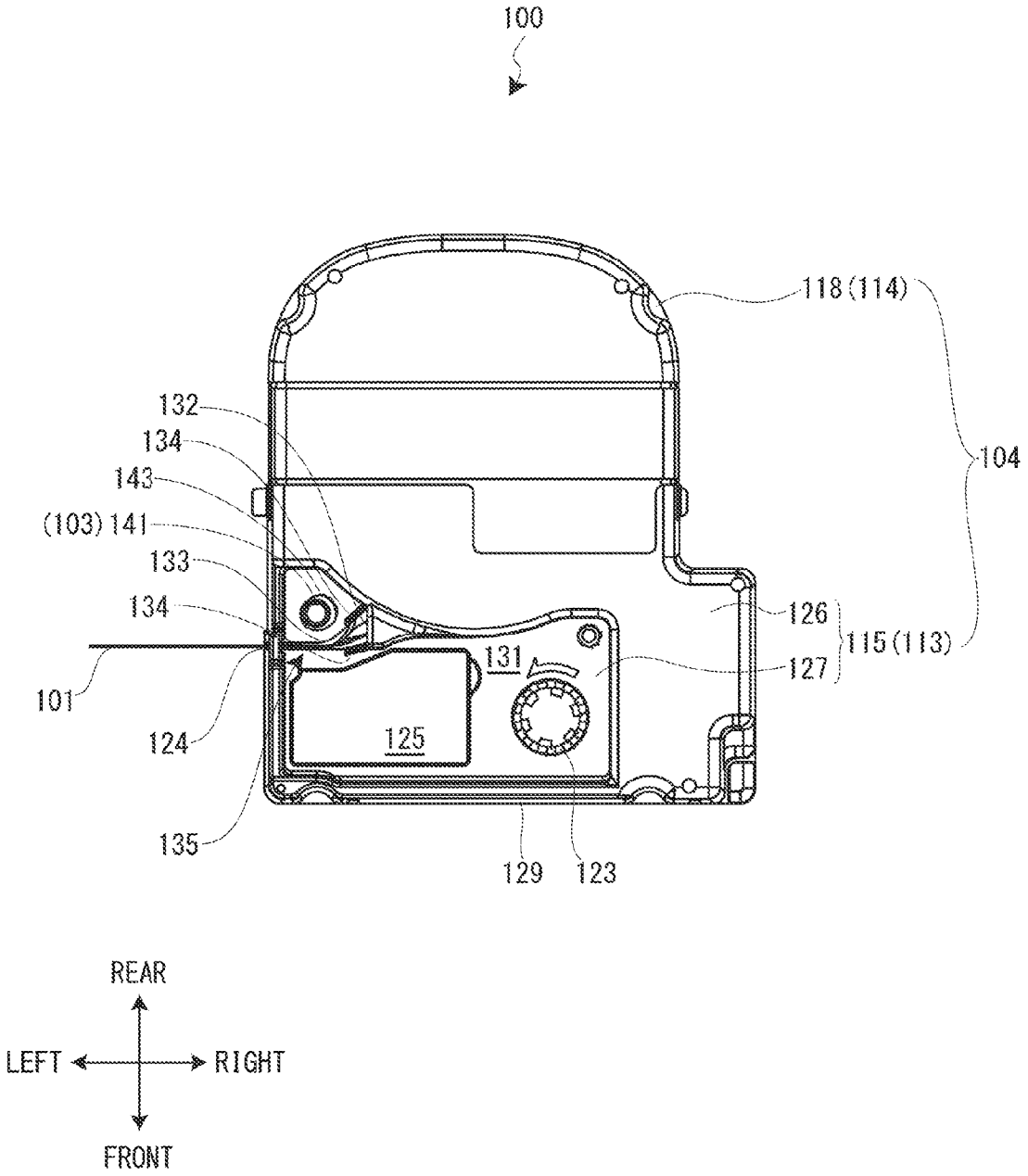
FIG. 5 is a plan view of the tape cartridge.

As shown in FIG. 3, the label tape 101 is so-called a die-cut label and has the plurality of label portions 105 formed into, for example, a corner-round rectangular shape at an even pitch in its length direction. The label tape 101 is constituted by a print tape 106 and a release tape 107 affixed to the rear side of the print tape 106 via an adhesive, and only the print tape 106 is cut out (half-cut) into the corner-round rectangular shape to form the respective label portions 105. Note that the label tape 101 may be such that other portions (frame portions) of the print tape 106 are released in advance with the respective label portions 105 remain intact.

The label tape 101 has a plurality of detection target portions 109 projecting in a rectangular shape in its width direction at one end (upper side in FIG. 3) in the width direction. The plurality of detection target portions 109 are provided along the length direction of the tape at the same pitch as those of the plurality of label portions 105 so as to individually correspond to the plurality of label portions 105. That is, ends (detection tip-ends 109*a*) on the paying-out tip-end side of the respective detection target portions 109 are positioned ahead of ends (label tip-ends 105*a*) on the paying-out tip-end side (on a downstream side in a tape feeding direction) of the respective label portions 105 in a paying-out direction by a prescribed distance, while ends (detection rear-ends 109*b*) on the paying-out terminal-end side of the respective detection target portions 109 substantially align with ends (label rear-ends 105*b*) on the paying-out terminal-end side (on an upstream side in the tape feeding direction) of the respective label portions 105 in the length direction of the tape. Of course, the positional relationship between the respective label portions 105 and the respective detection target portions 109 in the length direction of the tape is not limited to this, but the respective label portions 105 and the respective detection target portions 109 may only be required to have a prescribed positional relationship each other.

In addition, as will be described in later, the apparatus main body 200 controls the feeding of the label tape 101 based on whether the respective detection target portions 109 (the detection tip-ends 109*a* and the detection rear-ends 109*b*) have passed. Thus, the apparatus main body 200 starts printing on the respective label portions 105 from the label tip-ends 105*a* and cuts off the label tape 101 at a position behind the label rear-ends 105*b* by a prescribed distance. That is, the label tape 101 has print start spots 111 at the label tip-ends 105*a* of the respective label portions 105 and has cut spots 112 at positions behind the label rear-ends 105*b* of the respective label portions 105 by the prescribed distance. Of course, the positions of the print start spots 111 and the cut spots 112 with respect to the respective label portions 105 can be arbitrarily set. Moreover, a user may be capable of operating the print data creation apparatus to change the positions of the print start spots 111 and the cut spots 112.

As shown in FIGS. 4 to 7, the cartridge case 104 is joined such that an upper casing 113 and a lower casing 114 are abutted against each other so as to be separable. The upper casing 113 has a top wall portion 115 and an upper peripheral wall portion 116 projecting from the periphery of the top wall portion 115. The lower casing 114 has a bottom wall portion 117 and a lower peripheral wall portion 118 projecting from the periphery of the bottom wall portion 117. Note that the upper casing 113 is made of a semi-transparent resin and the lower casing 114 is made of a light-shielding (for example, black and non-transparent) resin.

In the cartridge case 104, a tape core 121 is accommodated on a rear side, a ribbon paying-out reel 122 and a ribbon winding-up reel 123 are accommodated at a right front end, and a platen roller 103 is accommodated at a left end. The label tape 101 is wound on the tape core 121 so as to be capable of being paid out. The ink ribbon 102 is wound on the ribbon paying-out reel 122 so as to be capable of being paid out, and the ink ribbon 102 paid out from the ribbon paying-out reel 122 is wound up by the ribbon winding-up reel 123. Note that the label tape 101 is accommodated in the cartridge case 104 so as to make the detection target portions 109 positioned on the side of the upper casing 113.

On the left side surface of the cartridge case 104, a slit-shaped tape delivery port 124 long in a top and bottom direction is formed to eject the label tape 101 to the outside of the cartridge case 104. In addition, at the left front corner portion of the cartridge case 104, a head opening 125 allowing the insertion of a print head 225 that will be describe later is formed so as to penetrate in the top and bottom direction.

The top wall portion 115 of the upper casing 113 is constituted by a high wall portion 126 (cover wall portion), a low wall portion 127, and a vertical wall portion 128. The high wall portion 126 is formed in a region in which the tape core 121 and the ribbon paying-out reel 122 are positioned in a plan view. The low wall portion 127 is formed so as to be lower than the high wall portion 126 (be closer to the bottom wall portion 117) in a region in which the ribbon winding-up reel 123, the platen roller 103, and the head opening 125 are positioned. The vertical wall portion 128 extends like a substantially lying "F"-shape and connects the high wall portion 126 and the low wall portion 127 to each other.

Moreover, the upper casing 113 has substantially "L"-shaped projection wall portions 129, which project at substantially the same height as the vertical wall portion 128 so as to extend upward from the upper peripheral wall portion 116, at the front edge and the left edge of the low wall portion 127. On the upper surface of the upper casing 113, concave space 131 having a substantially rectangular shape in a plan view is formed by the low wall portion 127, the vertical wall portion 128, and the projection wall portion 129.

The tape cartridge 100 has a thickness corresponding to the whole tape width of the label tape 101 (the tape width including the detection target portions 109) in a region in which the high wall portion 126 is formed, and an end surface on the upper side of the wound label tape 101 (on the side of the detection target portions 109) is covered with the high wall portion 126. Note that a remaining amount of the label tape 101 wound on the tape core 121 can be visually checked via the semi-transparent high wall portion 126. On the other hand, the tape cartridge 100 has a thickness corresponding to a tape width excluding the detection target portions 109 in a region in which the low wall portion 127 is formed, and the respective fed detection target portions 109 project upward from a projection opening 133 (that will be described later) formed in the low wall portion 127.

The vertical wall portion 128 has a passage port 132 through which the plurality of detection target portions 109 of the label tape 101 paid out from the tape core 121 passes one after another. The low wall portion 127 has the slit-shaped projection opening 133 that connects the passage port 132 and the tape delivery port 124 to each other, and the respective passing detection target portions 109 project upward. The projection opening 133 is formed to be wider on the side of the passage port 132 (on the upstream side in tape feeding direction) so as to correspond to a change in a feed path corresponding to a remaining amount of the label tape 101 (a winding amount of the label tape 101 on the tape core 121).

Moreover, a pair of front and rear tape cover portions 134 is formed at an end on the upstream side in the tape feeding direction of the projection opening 133 so as to extend in a rib shape from the edge of the passage port 132 to a downstream side in the tape feeding direction. That is, the pair of tape cover portions 134 projects from the front edge and the rear edge of the projection opening 133 at the end on the upstream side in the tape feeding direction of the projection opening 133. The pair of tape cover portions 134 is slightly lower than the vertical wall portion 128. Therefore, the upper ends of the pair of tape cover portions 134 are positioned to be lower than the upper end of the high wall portion 126.

Figure 12A:
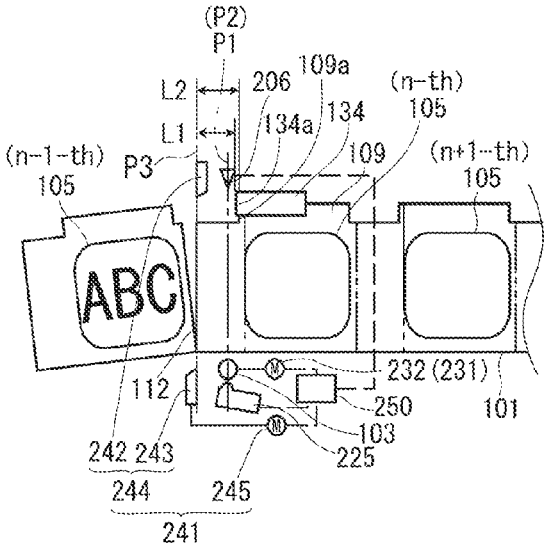
FIGS. 12A to 12E are views showing a print/cut operation in the label creation apparatus.

On a side upstream of a downstream end in the tape feeding direction of the tape cover portions 134 in the projection opening 133 (a cover-portion downstream end 134*a* (see FIG. 12A)), the respective detection target portions 109 projecting upward from the projection opening 133 are covered with the pair of tape cover portions 134 on the side of the print tape 106 and the side of the release tape 107. On the other hand, on a side downstream of the cover-portion downstream end 134*a* in the projection opening 133, the respective detection target portions 109 projecting upward from the projection opening 133 are exposed so as to be capable of being detected by the light sensor 206 that will be described later when passing through the light sensor 206. That is, the area between the cover-portion downstream end 134*a* and the tape delivery port 124 serves as an exposed area 135 in which the respective detection target portions 109 are exposed to allow the passage of the respective detection target portions 109 to be detected by the light sensor 206.

On the other hand, the bottom wall portion 117 covers an end surface on the lower side of the accommodated label tape 101 (on a side opposite to the side of the detection target portions 109). A guide wall 136 projects from the bottom wall portion 117 so as to surround the periphery of the head opening 125 except for a portion at which the platen roller 103 faces the print head 225. At the plurality of the places of the upper end surface of the guide wall 136, guide engagement holes 137 with which the engagement pins (not shown) of the upper casing 113 engage are formed. The ink ribbon 102 paid out from the ribbon paying-out reel 122 goes around the outer peripheral surface of the guide wall 136 and is then wound up by the ribbon winding-up reel 123. Note that the ink ribbon 102 has a width corresponding to the width of the respective label portions 105 (the length of the tape width direction).

Figure 7:
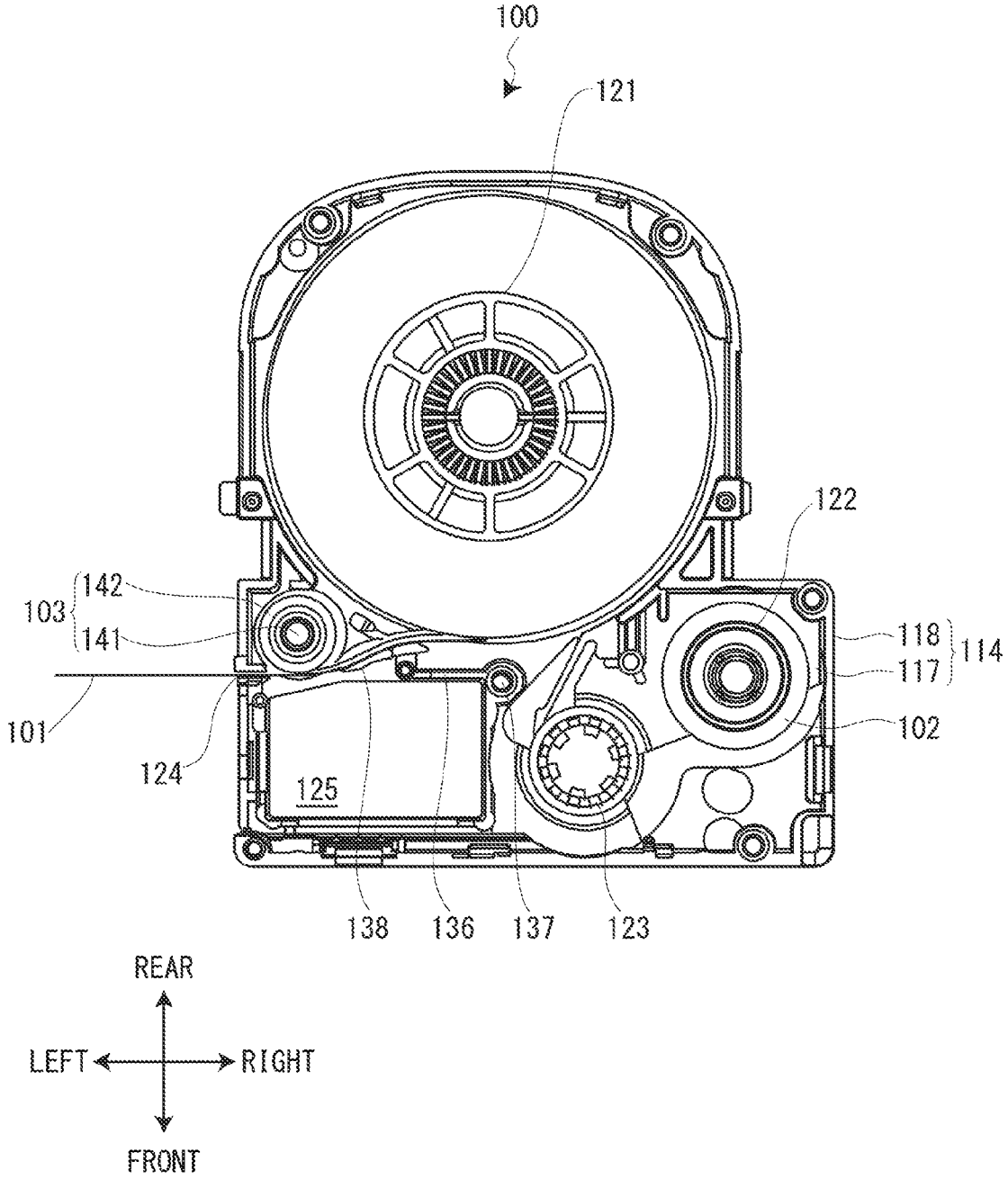
FIG. 7 is a plan view of the tape cartridge with the upper casing removed.
Figure 8:
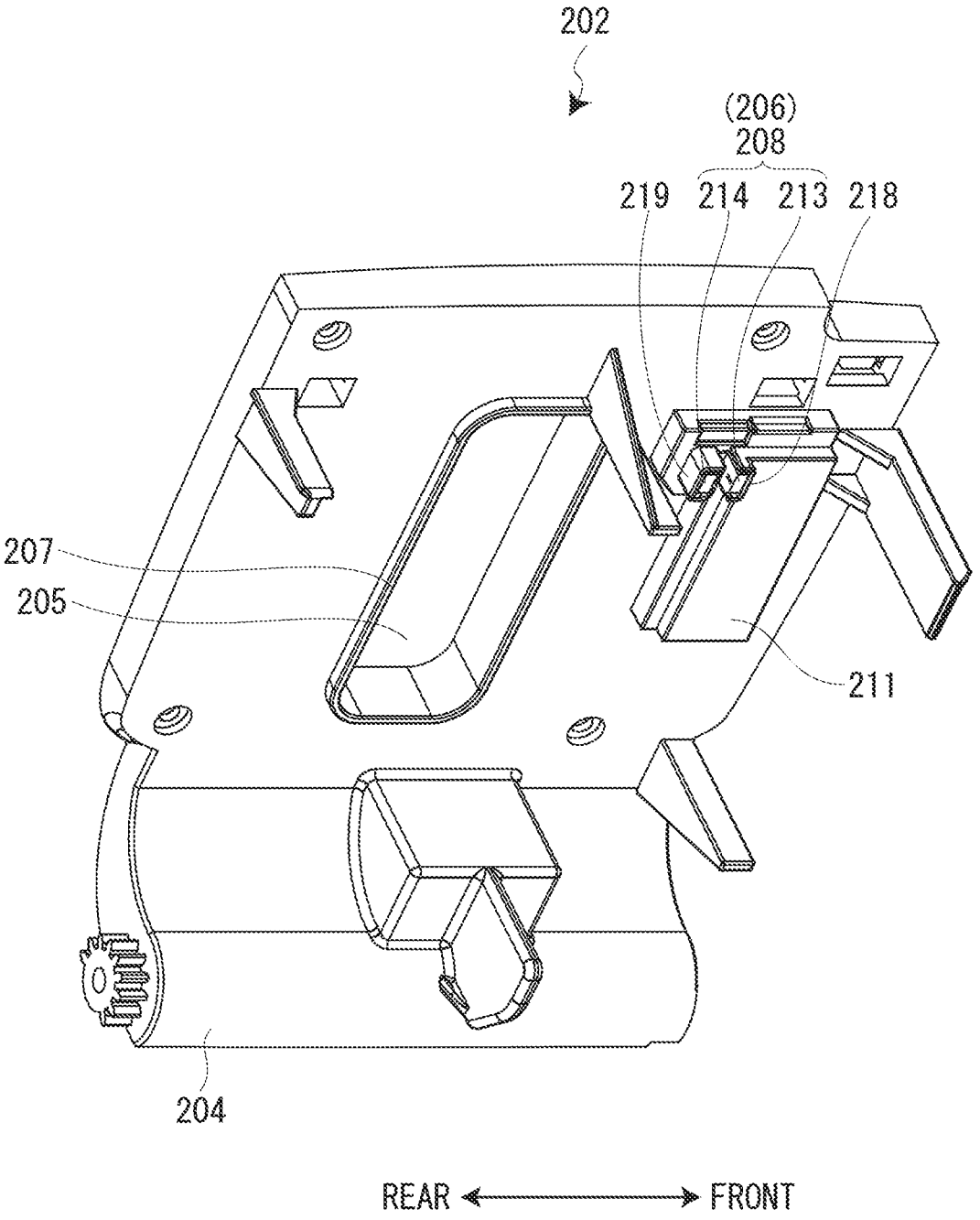
FIG. 8 is a perspective view of an opening/closing cover in a closed state when seen from its left lateral side.
Figure 9:
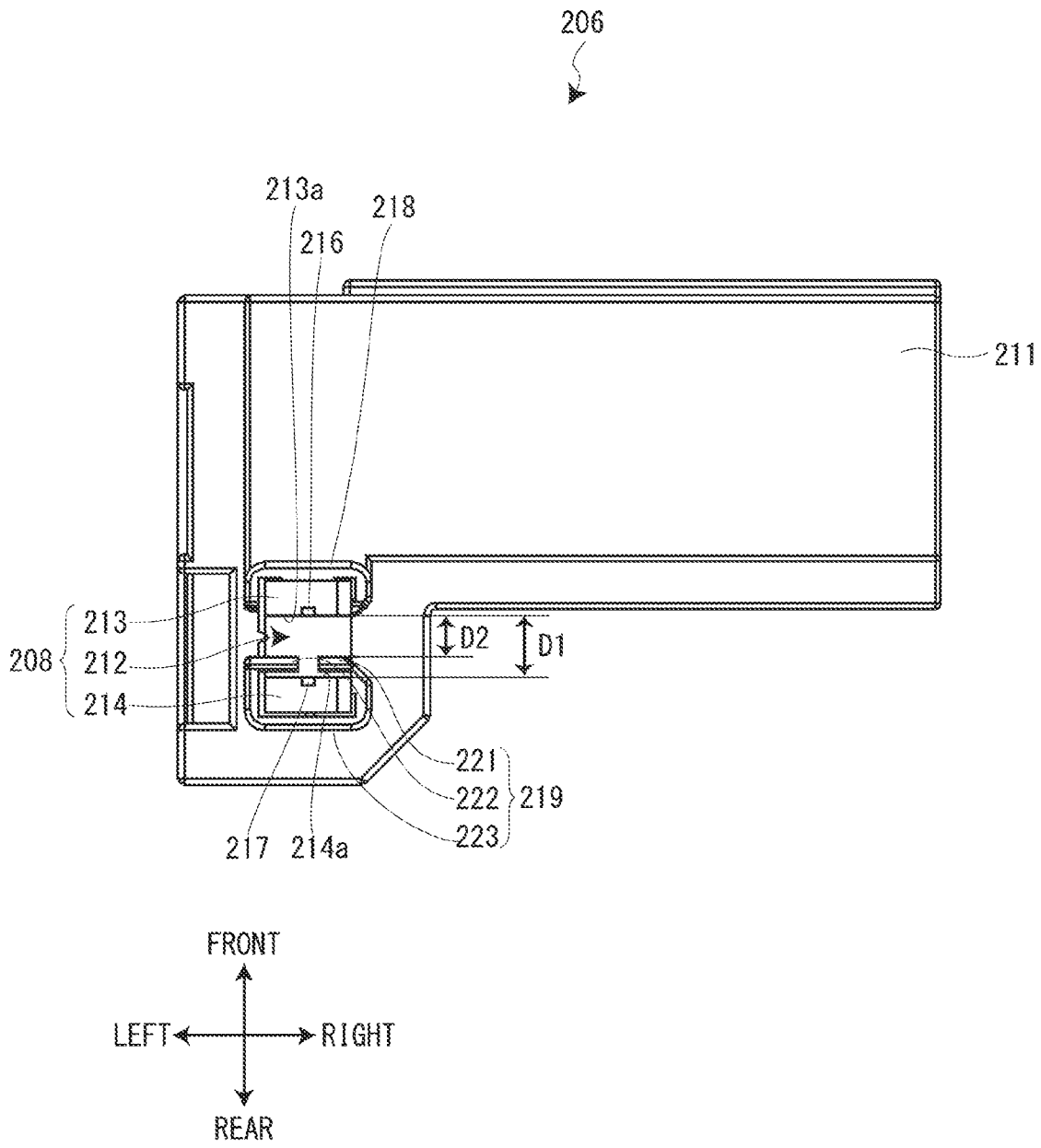
FIG. 9 is a bottom view of the opening/closing cover in the vicinity of a light sensor.

Moreover, a slender plate-shaped drawing prevention portion 138 projects in the vicinity of a side upstream of the platen roller 103 in the tape feeding direction and at a position overlapping with the platen roller 103 in a traverse direction traversing the feed path of the label tape 101 (in the direction crossing the feed path) (see FIG. 7). As will be described in detail later, the drawing prevention portion 138 prevents the label tape 101 from being drawn in the cartridge case 104 in cooperation with the platen roller 103.

The drawing prevention portion 138 is lower in height than the tape width of the label tape 101 excluding the detection target portions 109, and the height of the drawing prevention portion 138 is about, for example, 50% to 90% the tape width. That is, the tip end of the drawing prevention portion 138 does not engage with the top wall portion (low wall portion 127) 115 of the upper casing 113. Further, the drawing prevention portion 138 is formed to be thin in the traverse direction traversing the feed path of the label tape 101 and capable of elastically tilting to a side opposite to the platen roller 103 in the traverse direction (on the side of the head opening 125).

The rear surface of the drawing prevention portion 138 is formed into a gentle arc shape and contacts the side of the print tape 106 of the label tape 101. Here, as described above, the drawing prevention portion 138 is lower in height than the tape width of the label tape 101 excluding the detection target portions 109. Therefore, the drawing prevention portion 138 contacts the lower side of the label tape 101 but does not contact the upper side thereof. On the other hand, the front surface of the drawing prevention portion 138 contacts the ink ribbon 102. That is, the print tape 106 is fed while being brought into slide-contact with the rear surface of the drawing prevention portion 138, and the ink ribbon 102 is fed while being brought into slide-contact with the rear surface of the drawing prevention portion 138. The print tape 106 and the ink ribbon 102 merge with each other near the downstream side of the drawing prevention portion 138 and then is held between the platen roller 103 and the print head 225.

The tape delivery port 124 is formed to be slightly longer than the tape width of the label tape 101 (tape width including the detection target portions 109), formed to have the same width over its whole length, and formed to be slightly wider than the thickness of the label tape 101. The upper end of the tape delivery port 124 is constituted by the upper casing 113 and serves as a detection target passage 124*a* through which the respective detection target portions 109 pass. Chamfering portions 139 are formed at corners on the inner surface side of the cartridge case 104 of both front and rear edges of the detection-target passage 124*a* (see FIG. 10).

The platen roller 103 is provided so as to face the print head 225 inserted in the head opening 125. The platen roller 103 is rotated by the apparatus main body 200 and feeds by rotation the label tape 101 and the ink ribbon 102 held between the platen roller 103 and the print head 225.

The platen roller 103 has a roller main body 141 having a cylindrical shape and a platen rubber 142 wound on the roller main body 141. The platen roller 103 (the platen rubber 142) is brought into rolling-contact with the side of the release tape 107 of the label tape 101. The platen rubber 142 has a length corresponding to the width of the respective label portions 105 (the length in the tape width direction) like the ink ribbon 102.

The top wall portion 115 (the low wall portion 127) of the upper casing 113 has an upper platen engagement hole 143 with which the upper end of the roller main body 141 engages. Similarly, the bottom wall portion 117 of the lower casing 114 has a lower platen engagement hole (not shown) with which the lower end of the roller main body 141 engages.

Each of the upper platen engagement hole 143 and the lower platen engagement hole is formed to be long in the tape feeding direction. Thus, the platen roller 103 is rotatably accommodated in the cartridge case 104 and moves within a prescribed range in the tape feeding direction as the label tape 101 is paid out and drawn. Therefore, even if the label tape 101 is drawn, for example, when the tape core 121 is rotated due to vibrations in a state in which the tape cartridge 100 is not installed in the apparatus main body 200, the platen roller 103 moves to the upstream side in the tape feeding direction as the label tape 101 is drawn, whereby the label tape 101 is held between the platen roller 103 and the above drawing prevention portion 138. Thus, the label tape 101 is not further drawn, and the tip end of the label tape 101 is prevented from getting in the cartridge case 104.

As shown in FIGS. 1 and 2, the outer shell of the apparatus main body 200 is formed by an apparatus casing 201 having a substantially cubic shape. An opening/closing cover 202 is provided at the upper surface of the apparatus casing 201. The opening/closing cover 202 opens/closes a cartridge installation portion 210 in which the tape cartridge 100 is installed. A cover opening button 203 for opening the opening/closing cover 202 is provided at the left-front corner portion of the apparatus main body 200. When the user presses the cover opening button 203, the opening/closing cover 202 rotates upward about a hinge portion 204 provided at a right end.

The tape cartridge 100 is installed in the cartridge installation portion 210 with the upper casing 113 directed upward and the lower casing 114 directed downward. Therefore, when the tape cartridge 100 is installed in the cartridge installation portion 210, the respective detection target portions 109 projecting upward from the projection opening 133 formed in the upper casing 113 (the low wall portion 127) face the rear side of the closed opening/closing cover 202.

As shown in FIGS. 8 to 11, the opening/closing cover 202 has a check window 205, which is long in a right and left direction and has a rectangular shape with round corners, at a substantially central portion, and the rear side of the opening/closing cover 202 is provided with the light sensor 206 that is positioned in front of the check window 205 and detects the passage of the respective detection target portions 109.

The check window 205 is made of a translucent resin, and the installation/uninstallation of the tape cartridge 100 in/from the cartridge installation portion 210 can be visually checked via the check window 205. Note that except for the check window 205, the apparatus casing 201 with the opening/closing cover 202 is made of a light-shielding resin. On the rear side of the opening/closing cover 202, a rib-shaped annular convex portion 207 projects from the peripheral edge portion of the check window 205. The annular convex portion 207 is also made of a light-shielding resin. The annular convex portion 207 is formed to have a height at which a slight gap is generated between the annular convex portion 207 and the upper surface of the tape cartridge 100 installed in the cartridge installation portion 210 in a state in which the opening/closing cover 202 is closed.

The light sensor 206 is constituted by a transmission-type photo interrupter and has a light-emission element 216 and a light-reception element 217 facing each other, a sensor casing 208 in which the light-emission element 216 and the light-reception element 217 are accommodated, and a sensor substrate 209 on which a circuit element is mounted. The light-emission element 216 is constituted by, for example, an infrared light-emission diode, and the light-reception element 217 is constituted by, for example, an infrared photo transistor. The sensor substrate 209 is accommodated in a substrate accommodation portion 211 slightly projecting from the rear surface of the opening/closing cover 202 in a lying "L"-shape in a bottom view. In a state in which the cover is closed, the light sensor 206 is positioned in the concave space 131 (the exposed area 135) formed in the upper surface of the cartridge case 104. Note that when the opening/closing cover 202 is closed, the substrate accommodation portion 211 is accommodated in the concave space 131 formed in the tape cartridge 100 and prevented from interfering with the top wall portion 115 of the tape cartridge 100 (see FIG. 10).

Figure 10:
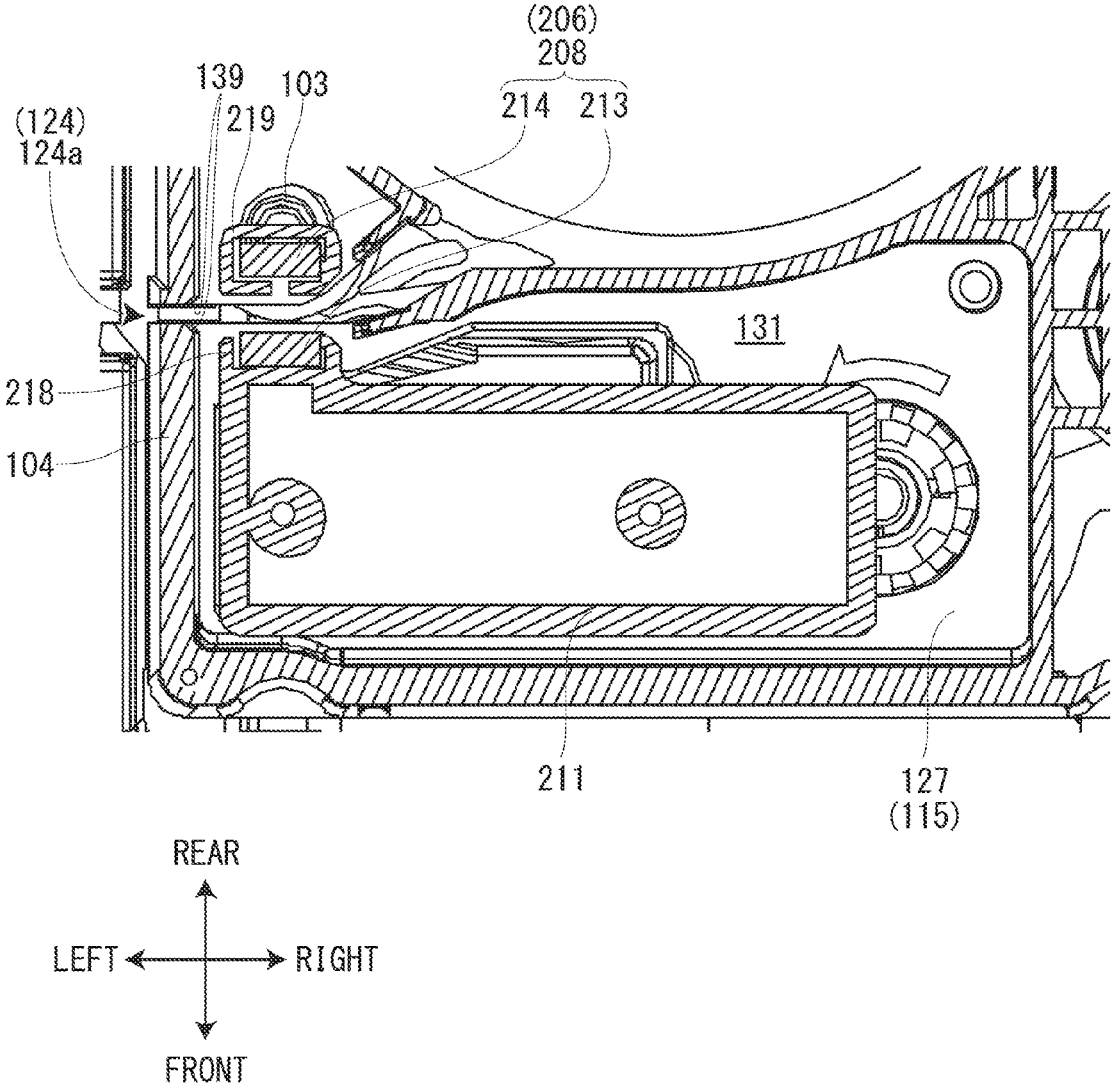
FIG. 10 is a horizontal cross-sectional view of the label creation apparatus in the vicinity of the light sensor.
Figure 11:
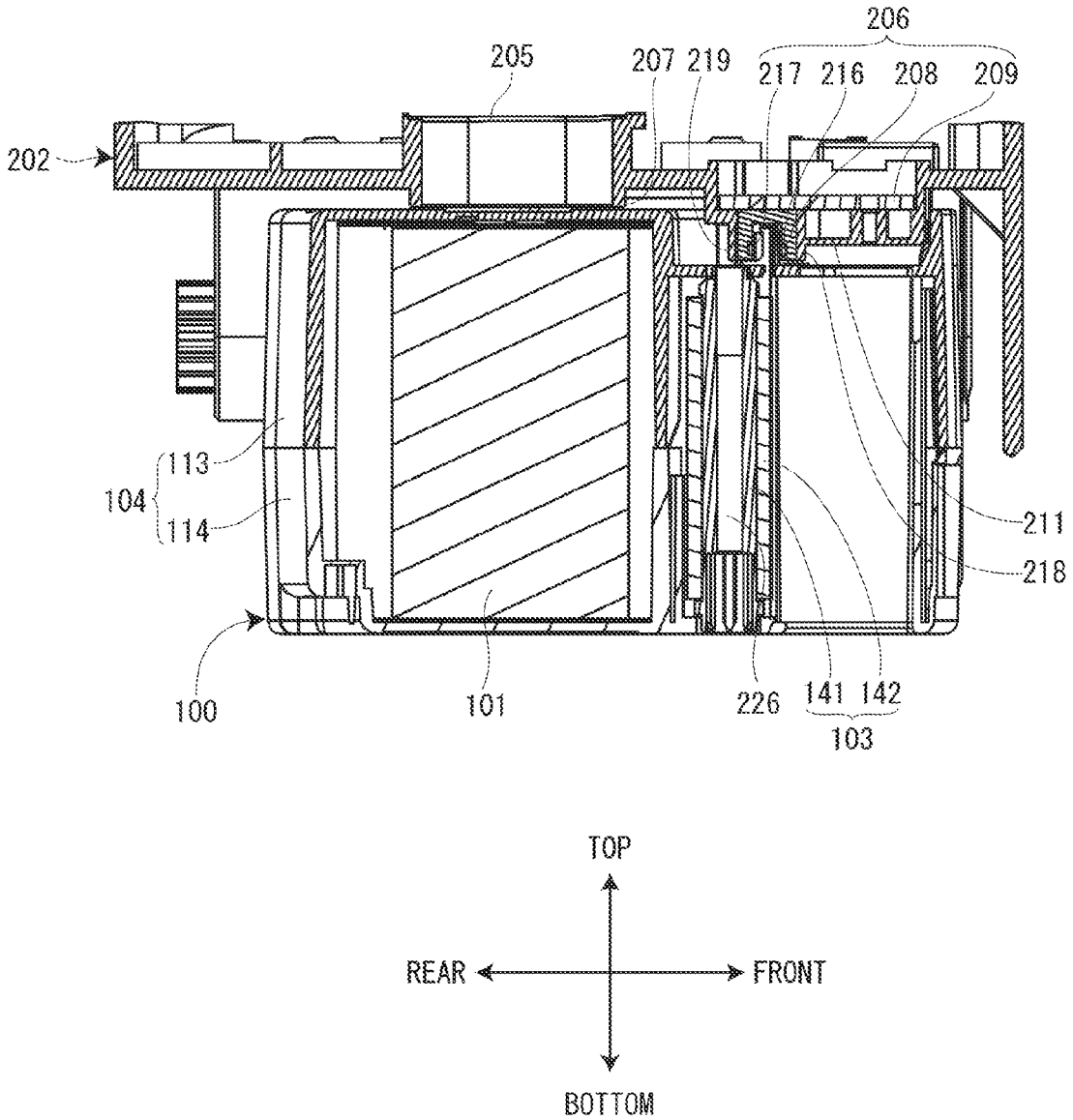
FIG. 11 is a vertical cross-sectional view of the label creation apparatus in the vicinity of the light sensor.

The sensor casing 208 has a substantially reverse "U"-shape in a side view. In the sensor casing 208, a light-reception-side accommodation portion 214 in which the light-reception element 217 is accommodated and a light-emission-side accommodation portion 213 in which the light-emission element 216 is accommodated are disposed in the front and rear direction across a groove portion 212 serving as a feed path. That is, in a state in which the opening/closing cover 202 is closed, the light sensor 206 is attached to the opening/closing cover 202 with the light-emission-side accommodation portion 213 (the light-emission element 216) positioned on a front side and the light-reception-side accommodation portion 214 (the light-reception element 217) positioned on a rear side (on the side of the check window 205). That is, the light-reception element 217 turns its back to the check window 205. Moreover, as shown in FIG. 10, the position of the light axis of detection light from the light sensor 206 aligns with the position of the shaft of the platen roller 103 in the tape feeding direction. That is, a position P1 (see FIGS. 12A, 12B, and 12D) detected by the light sensor 206 aligns with a print position P2 by the print head 225 in the tape feeding direction (see FIGS. 12A to 12E).

The light-emission-side accommodation portion 213 and the light-reception-side accommodation portion 214, respectively, have a light-emission-side facing surface 213*a* and a light-reception-side facing surface 214*a* facing each other. The respective detection target portions 109 pass through the area between the light-emission-side facing surface 213*a* and the light-reception-side facing surface 214, i.e., the groove portion 212. A distance (facing distance D1, see FIG. 9) that is the distance between the light-emission-side facing surface 213*a* and the light-reception-side facing surface 214*a*, i.e., the width of the groove portion 212 is, for example, about 4 mm. In addition, each of the light-emission-side facing surface 213*a* and the light-reception-side facing surface 214*a* has a slit to allow detection light emitted from the light-emission element 216 to pass through.

Moreover, a light-emission-side convex portion 218 having a reverse "U"-shape in a bottom view and a light-reception-side convex portion 219 having a lying "C"-shape in a bottom view project from the lower surface of the substrate accommodation portion 211. Each of the light-emission-side convex portion 218 and the light-reception-side convex portion 219 is made of a light-shielding resin. Note that the upstream-side corner portion of the light-emission-side convex portion 218 and the upstream-side corner portion of the light-reception-side convex portion 219 are chamfered to prevent the detection tip-ends 109*a* of the respective fed detection target portions 109 from getting stuck on the corner portions.

The light-emission-side convex portion 218 covers the peripheral surface of the light-emission-side accommodation portion 213 excluding a light-emission-side facing surface 213*a*. On the other hand, the light-reception-side convex portion 219 is integrally constituted by a light-reception-side upstream guide portion 221, a light-reception-side downstream guide portion 222, and a light-reception-side cover portion 223. The light-reception-side upstream guide portion 221 is formed at one tip end so as to close some (the light-reception side) of the upstream-side opening portion of the groove portion 212. The light-reception-side downstream guide portion 222 is formed at the other tip end so as to close some (the light-reception side) of the downstream-side opening portion of the groove portion 212. The light-reception-side cover portion 223 covers the peripheral surface of the light-reception-side accommodation portion 214 excluding a light-reception-side facing surface 214*a*.

Each of the light-reception-side upstream guide portion 221 and light-reception-side downstream guide portion 222 internally extends to the near side of the light-reception element 217 along the light-reception-side facing surface 214*a*. The respective detection target portions 109 pass through the groove portion 212 while being guided by the front surfaces of the light-reception-side upstream guide portion 221 and the light-reception-side downstream guide portion 222 and the light-emission-side facing surface 213*a*. That is, the respective detection target portions 109 are fed between the light-reception-side upstream guide portion 221 and the light-reception-side downstream guide portion 222 and the light-emission-side facing surface 213*a* at a guide width D2 narrower than the above facing distance D1 (see FIG. 9).

As shown in FIG. 2, the print head 225 of a thermal type projects from the left-front corner of the cartridge installation portion 210. The tape cartridge 100 is installed in the cartridge installation portion 210 so as to make the print head 225 inserted in the head opening 125. Moreover, a platen driving shaft 226 that faces the print head 225 and engages with and rotates the platen roller 103 inside the tape cartridge 100 is provided to stand in the cartridge installation portion 210. Note that a guide projection that guides the installation of the tape cartridge 100 projects from the substantially central portion of the cartridge installation portion 210 and a ribbon winding-up driving shaft that engages with and rotates the ribbon winding-up reel 123 is provided to stand on the right side of the print head 225.

Moreover, a feed portion 231 that rotates the platen driving shaft 226 and the ribbon winding-up driving shaft is provided on the rear side of the cartridge installation portion 210. The feed portion 231 has a feed motor 232 serving as a power source and a feed-power transmission mechanism (not shown) constituted by a gear train or the like that divides and transmits the power of the feed motor 232 to the platen driving shaft 226 and the ribbon winding-up driving shaft (see FIG. 12A). When the feed portion 231 rotates the platen driving shaft 226 and the ribbon winding-up driving shaft, the platen roller 103 and the ribbon winding-up reel 123 rotate to feed the label tape 101 and the ink ribbon 102.

A slit-shaped tape ejection port 234 long in the top and bottom direction is formed at the left side portion of the apparatus casing 201. The tape ejection port 234 communicates with the cartridge installation portion 210, and the label tape 101 fed from the tape cartridge 100 installed in the cartridge installation portion 210 is ejected to the outside of the apparatus via the tape ejection port 234.

A cutting portion 241 that cuts off the label tape 101 is provided between the cartridge installation portion 210 and the tape ejection port 234. The cutting portion 241 has a fixed blade 242 and a movable blade 243 with the feed path of the label tape 101 held therebetween and is constituted by a cutter 244 that cuts off the label tape 101 like scissors, a cutter motor 245 that serves as the power source of the movable blade 243, a cutter power transmission mechanism (not shown) that transmits the power of the cutter motor 245 to the movable blade 243, or the like (see FIG. 12A).

In the tape feeding direction, a position at which the respective blade edges (blade lines) of the fixed blade 242 and the movable blade 243 are scraped is a cut position P3 at which the label tape 101 is cut off. Further, in the tape feeding direction, a distance L1 between the cut position P3 and the above cover-portion downstream end 134*a* (the upstream end of the exposed area 135) is shorter than a distance L2 (L1<L2) between the detection tip-end 109*a* of the detection target portion 109 corresponding to the n-th label portion 105 from the paying-out tip-end side and the cut spot 112 of the n−1-th label portion 105 (see FIG. 12A).

Moreover, the apparatus main body 200 has a CPU (Central Processing Unit) and a control unit 250 (see FIGS. 12A to 12E) constituted by various storage elements or the like. As will be described later, the control unit 250 drives and controls the feed motor 232 and the cutter motor 245 based on the passage detection (a change in the output voltage) of the various detection target portions 109 by the light sensor 206.

A description will be given of a print/cut operation in the label creation apparatus 1 with reference to FIGS. 12A to 12E. Note that in FIGS. 12A to 12E, the platen roller 103, the print head 225, and the movable blade 243 are shown in black at a driving time and shown in white at a non-driving time. In addition, the light sensor 206 is shown in black when the passage of the respective detection target portions 109 (the detection tip-ends 109*a* and the detection rear-ends 109*b*) is detected and shown in white when the passage is not detected.

First, it is assumed that the n−1-th label portion 105 from the upstream side in the tape feeding direction (the paying-out tip-end side) is separated at the prescribed cut spot 112 in a previous print/cut operation. At this time, the tip end of the label tape 101 aligns with the cut position P3 until a print/cut operation with respect to the label tape 101 starts. In addition, the detection tip-end 109*a* of the detection target portion 109 corresponding to the n-th label portion 105 is positioned slightly upstream (for example, 4 mm) of the detection position P1 of the light sensor 206 in the tape feeding direction (see FIG. 12A).

When the user inputs a print start in this state, the control unit 250 drives the feed motor 232 and the platen roller 103 rotates to start feeding the label tape 101 (and the ink ribbon 102). Then, when the detection tip-end 109*a* of the detection target portion 109 corresponding to the n-th label portion 105 reaches the detection position P1, the light sensor 206 detects the passage of the detection tip-end 109*a* and outputs the detection result to the control unit 250 (see FIG. 12B).

Upon receiving the detection result showing the passage of the detection tip-end 109*a*, the control unit 250 feeds the label tape 101 by a prescribed amount such that the print start spot 111 (the label tip-end 105*a*) of the n-th label portion 105 reaches the print position P2. Then, the control unit 250 drives the print head 225 to start printing with respect to the n-th label portion 105 from the print start spot 111 (see FIG. 12C).

Figure 12D:
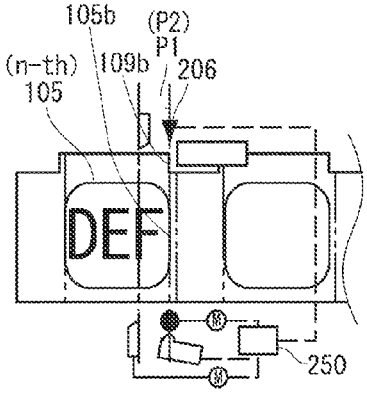
Figure 12B:
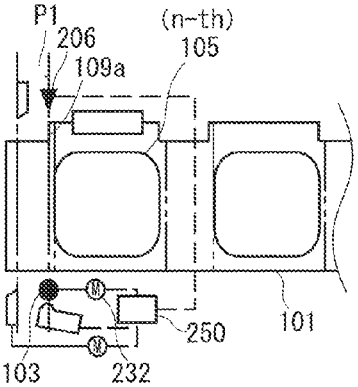
Figure 12E:
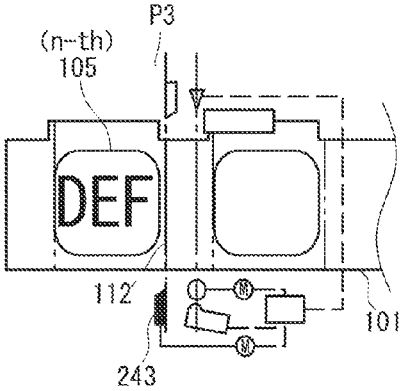
Figure 12C:
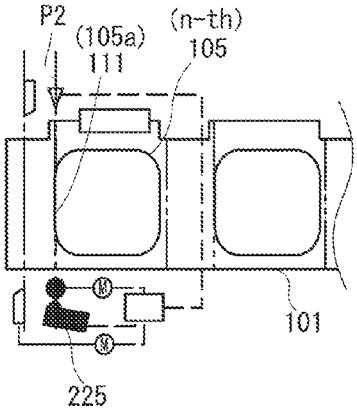

Then, when the detection rear-end 109*b* of the detection target portion 109 corresponding to the n-th label portion 105 reaches the detection position P1, the light sensor 206 detects the passage of the detection rear-end 109*b* and outputs the detection result to the control unit 250 (see FIG. 12D). Note that since the label rear-end 105*b* of the n-th label portion 105 reaches the print position P2 at this time, printing on the n-th label portion 105 is completed.

Upon receiving the detection result of the passage of the detection rear end 109*b*, the control unit 250 feeds the label tape 101 by a prescribed amount such that the cut spot 112 of the n-th label portion 105 reaches the cut position P3. Then, the control unit 250 drives the movable blade 243 to cut off the label tape 101 at the cut spot 112 and separate the n-th label portion 105 (see FIG. 12E). In the way described above, the label with a desired print can be created by the label creation apparatus 1. Note that the above description refers to a case in which one of the label portions 105 is printed and separated. However, the present invention is not limited to this, and it may also be possible to perform printing on the plurality of label portions 105 one after another and cut off the label tape 101 at the cut spot 112 of the rear most one of the label portions 105 to separate the plurality of label portions 105 in a lump.

Meanwhile, if the detection target portion 109 corresponding to the n-th label portion 105 is exposed in the exposed area 135 until the next tape feeding is performed in succession to the separation of the n−1-th label portion 105, there is a likelihood that the detection target portion 109 contacts a user's finger or the like to be folded after the opening/closing cover 202 is opened for the replacement or the like of the tape cartridge 100. Specifically, if the detection target portion 109 is folded, it is held between the light sensor 206 and the cartridge case 104 (the top wall portion 115), which may result in a factor responsible for jamming.

In this regard, according to the embodiment, the distance L1 between the cut position P3 and the cover-portion downstream end 134*a* is shorter than the distance L2 between the detection tip-end 109*a* of the detection target portion 109 corresponding to the n-th label portion 105 and the cut spot 112 of the n−1-th label portion 105 in the tape feeding direction as described above. In addition, in a state in which the n−1-th label portion 105 is separated at the cut spot 112, the cut spot 112 of the n−1-th label portion 105 aligns with the cut position P3 in the tape feeding direction (see FIG. 12A). Therefore, the detection tip-end 109*a* of the detection target portion 109 corresponding to the n-th label portion 105 is positioned upstream of the cover-portion downstream end 134*a* (the upstream end of the exposed area 135). Thus, in a state in which the n−1-th label portion 105 is separated, the detection target portion 109 corresponding to the n-th label portion 105 is not exposed in the exposed area 135. Accordingly, until the next tape feeding is performed in succession to the separation of the n−1-th label portion 105, the detection target portion 109 corresponding to the n-th label portion 105 can be prevented from contacting a user's finger or the like.

In other words, since the pair of tape cover portions 134 is provided at an upstream end in the tape feeding direction of the projection opening 133, the side of the print tape 106 and the side of the release tape 107 of the detection target portion 109 having passed through the passage port 132 are covered with the pair of tape cover portions 134. Thus, the detection target portion 109 projecting from the projection opening 133 can be prevented from contacting a user's finger or the like.

Figure 13:
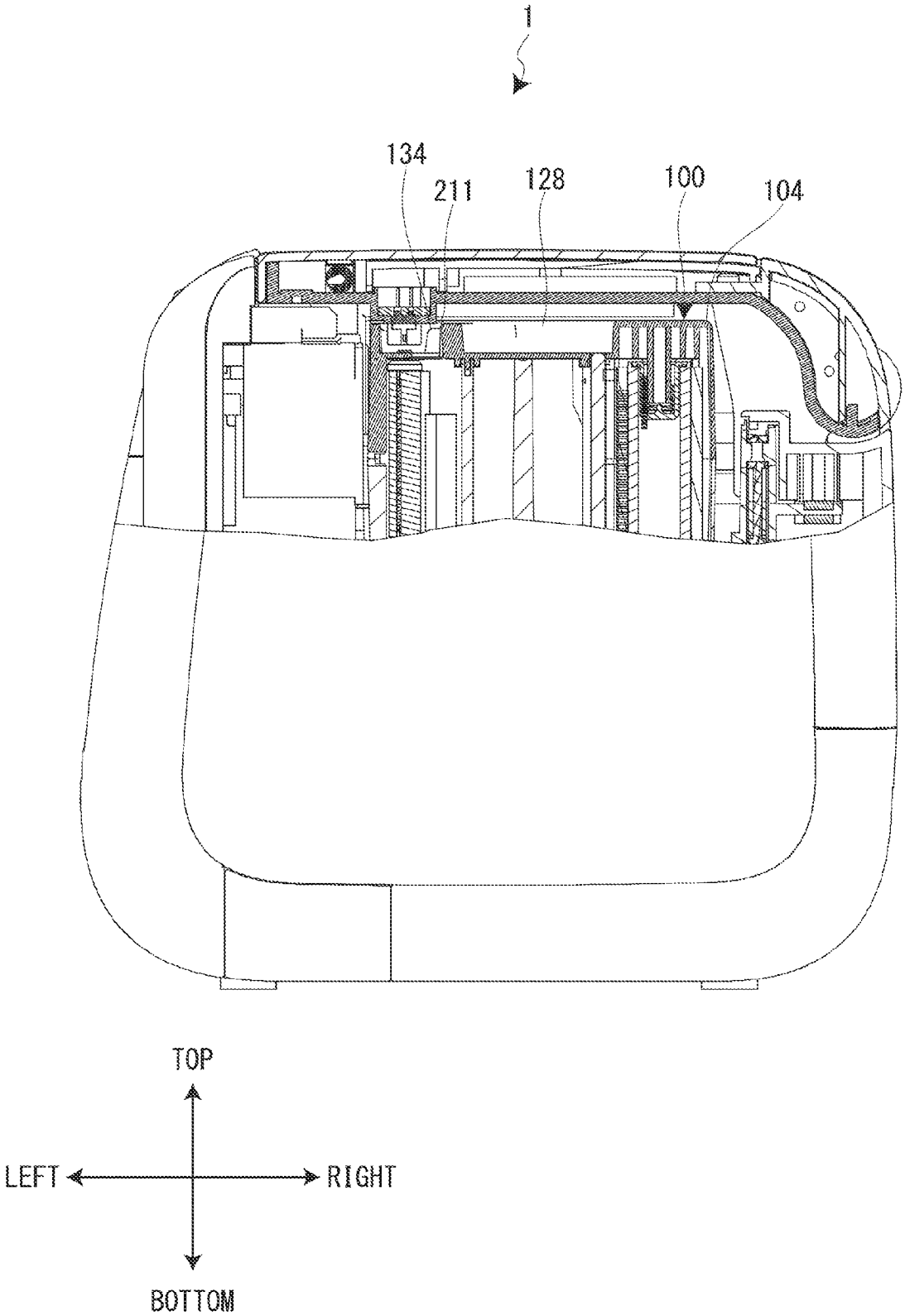
FIG. 13 is a partially vertical cross-sectional view of the label creation apparatus in the vicinity of the light sensor.

Moreover, as described above, the upper ends of the pair of tape cover portions 134 are positioned to be lower than the upper end of the high wall portion 126 (the upper end of the vertical wall portion 128) of the cartridge case 104 (see FIG. 13). Thus, it becomes possible to dispose another member (the substrate accommodation portion 211) so as not to interfere with the tape cover portions 134 at a position higher than the tape cover portions 134 and same in height as the upper end of the high wall portion 126 (the upper end of the vertical wall portion 128). Accordingly, a degree of flexibility in the arrangement of the members in the label creation apparatus 1 can be increased.

As described above, according to the label creation apparatus 1 and the tape cartridge 100 of the embodiment, the detection target portions 109 can be prevented from contacting a finger or the like when the exposed area 135 is provided in the cartridge case 104 to cause the detection target portions 109 of the label tape 101 to be exposed. Note that a sensor in another form such as a reflection-type photo interrupter may be used as a detection unit that detects the passage of the detection target portions 109. Moreover, the present invention is also applicable to an apparatus for feeding a cutting target such as a cutting plotter without having a print function.

Meanwhile, when a swinging amount of the label tape 101 delivered from the tape delivery port 124 of the cartridge case 104 becomes great, the running performance, the installation performance, and the cutting performance of the label tape 101 are adversely affected. Accordingly, the width of the tape delivery port 124 is preferably small to a greater extent to minimize the swinging amount of the label tape 101. However, the label tape 101 has the plurality of detection target portions 109. Therefore, when the width of the tape delivery port 124 is small, each of the detection tip-ends 109*a* gets stuck on the corner of the tape delivery port 124 every time it passes through the tape delivery port 124, whereby the release tape 107 is likely to be separated at the detection tip-end 109*a*. In this case, the print tape 106 of the detection tip-end at which the release tape 107 is separated adheres to the edge of the tape delivery port 124, the edge of the tape ejection port 234, or the like, which may result in a factor responsible for jamming.

In this regard, according to the tape cartridge of the embodiment, the C-chamfering portions 139 are formed at the corners on the inner surface side of the edges of the detection target passage 124*a*. Thus, when the respective detection target portions 109 pass through the detection target passage 124*a*, they can be prevented from getting stuck on the corner of the tape delivery port 124. Since the width of the tape delivery port 124 is not required to be increased only with the C-chamfering portions 139, the swinging amount of the label tape 101 delivered from the tape delivery port 124 does not become great in a direction crossing the feeding direction of the label tape 101. Therefore, the running performance or the like of the label tape 101 is not impaired. Note that the C-chamfering portions 139 may be formed into other shapes such as an R surface so long as the detection tip-ends 109*a* can be prevented from getting stuck on the corner of the tape delivery port 124.

In addition, since the tape delivery port 124 is formed to have substantially the same width over its whole length and formed to be slightly wider than the thickness of the label tape 101, the swinging amount of the label tape 101 delivered from the tape delivery port 124 can be made smaller in the direction crossing the feeding direction. Thus, the running performance or the like of the label tape 101 can be more satisfactorily obtained.

As described above, according to the tape cartridge 100 of the embodiment, the detection target portions 109 projecting in the tape width direction at the one end in the tape width direction of the label tape 101 can be prevented from getting stuck on the tape delivery port 124 without impairing the running performance or the like of the label tape 101. Note that the embodiment exemplifies the detection target portions 109 used to detect the passage of the label tape 101 with the light sensor 206 as convex portions projecting in the tape width direction at the one end in the tape width direction of the label tape 101. However, the present invention is not limited to this, and convex portions may be formed for the purpose of, for example, the decoration of the label tape 101. In addition, the embodiment exemplifies the tape cartridge 100 installed in the label creation apparatus 1. However, the tape cartridge 100 may be installed in an apparatus for feeding a cutting target such as a cutting plotter without having a print function. Alternatively, the tape cartridge 100 is not required to be installed in an apparatus, but the user may pull out the label tape 101 by hand for use.

Figure 14A:
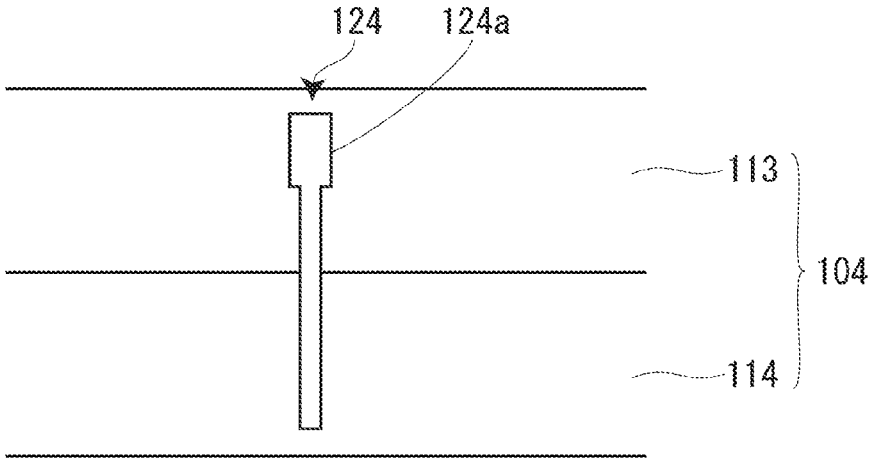
FIGS. 14A and 14B are side views showing a modified example of a tape delivery port formed in a cartridge case.
Figure 14B:
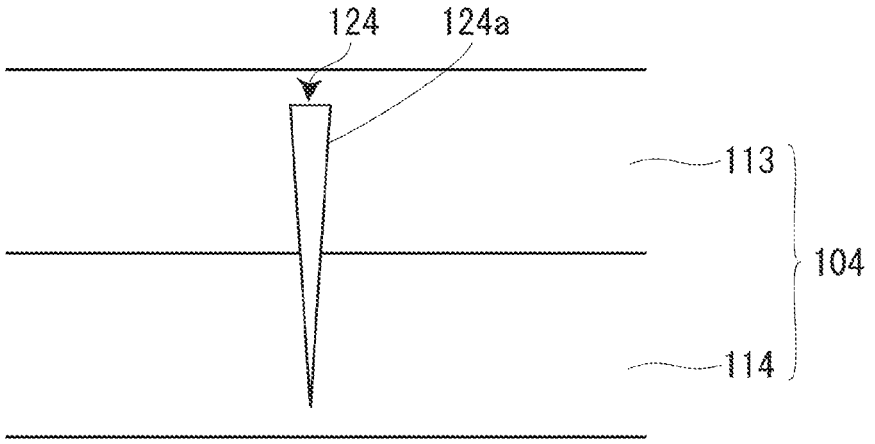
Figure 14B:
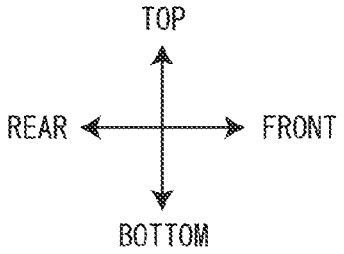

A description will be given of a modified example of the tape delivery port 124, focusing on a difference in the tape delivery port 124 between the modified example and the above embodiment. The tape delivery port 124 of a first modified example is such that the detection target passage 124*a* does not have the C-chamfering portions 139 at the corners on the inner surface side of the edges but is formed to be wider than other portions with a step (see FIG. 14A). In addition, the tape delivery port 124 of a second modified example is formed into a reverse triangular shape slender as a whole. Like the first modified example, the tape delivery port 124 is such that the detection target passage 124*a* does not have the C-chamfering portions 139 at the corners on the inner surface side of the edges but is formed to be wider than other portions (see FIG. 14B).

As described above, the detection target passage 124*a* of the tape delivery port 124 is formed to be wider than other portions. Therefore, when the respective detection target portions 109 pass through the detection target passage 124*a*, the detection tip-ends 109*a* can be prevented from getting stuck on the corners on the inner surface side of the edges of the detection target passage 124*a*. In addition, the detection target passage 124*a* is formed to be wider, but the whole width of the tape delivery port 124 is not increased. Therefore, the swinging amount of the label tape 101 delivered from the tape delivery port 124 does not become great, and thus the running performance or the like of the label tape 101 is not impaired. Note that in the first modified example and the second modified example as well, the C-chamfering portions 139 may be formed at the corners on the inner surface side of the edges of the detection target passage 124*a*.

In addition, in the case of the label tape 101 in which other portions of the print tape 106 are separated in advance with the respective label portions 105 remain intact, the label portions 105 of the label tape 101 are thicker than other portions in the tape width direction. Therefore, the portion of the tape delivery port 124 at which the respective label portions 105 pass through may be formed to be wider than other portions.

EXPLANATION OF REFERENCE SYMBOLS

1: label creation apparatus
100: tape cartridge
105: label portion
109: detection target portion
200: apparatus main body
206: light sensor

The invention claimed is:

1. A tape cartridge to be installed in a tape printing apparatus having a cartridge installation portion and a cutting portion that cuts off a tape-shaped member, the tape cartridge comprising:

the tape-shaped member having a plurality of label portions provided along a length direction of the tape-shaped member and a plurality of detection target portions provided along the length direction of the tape-shaped member so as to correspond to the plurality of label portions on one side thereof in a tape width direction and projecting in the tape width direction; and a cartridge case in which the tape-shaped member is accommodated so as to be capable of being paid out, wherein the cartridge case has an exposed area, in which the respective detection target portions are exposed to detect passage of the respective detection target portions, on a feed path of the tape-shaped member, and a distance between a cut position of the cutting portion and an upstream end of the exposed area is shorter than a distance between an end on a paying-out tip-end side of the detection target portion corresponding to any of the label portions and the cut spot of another of the label portions adjacent to the label portion concerned on the paying-out tip-end side in a tape feeding direction.

2. The tape cartridge according to claim 1, wherein the cartridge case has a cover wall portion that covers an end surface on the one side of the tape-shaped member, the cover wall portion has a projection opening that causes the respective detection target portions to project to the one side, a tape cover portion that covers the respective passing detection target portions is provided at an upstream end in the tape feeding direction of the projection opening, and the exposed area is formed downstream of the tape cover portion in the tape feeding direction.

3. The tape cartridge according to claim 2, wherein, in the tape width direction, an end on the one side of the tape cover portion is positioned closer to the other side than an end on the one side of the cover wall portion.

4. The tape cartridge according to claim 1, wherein the cartridge case has a slit-shaped tape delivery port, and a detection target passage of the tape delivery port, through which the respective detection target portions pass, have a chamfering portion at a corner on an inner surface side of the cartridge case of an edge thereof.

5. The tape cartridge according to claim 4, wherein the tape delivery port is formed to have substantially a same width over a whole length thereof.

6. The tape cartridge according to claim 4, wherein the tape delivery port is such that the detection target passage is formed to be wider than other portions thereof.

7. The tape cartridge according to claim 1, wherein the cartridge case has a slit-shaped tape delivery port, and the tape delivery port is such that the detection target passage, through which the respective detection target portions pass, is formed to be wider than other portions thereof.

8. A tape feeding apparatus comprising:

a tape cartridge having a tape-shaped member and a cartridge case in which the tape-shaped member is accommodated so as to be capable of being paid out, the tape-shaped member having a plurality of label portions provided along a tape length direction and a plurality of detection target portions provided along the tape length direction so as to correspond to the plurality of label portions at one end in a tape width direction and projecting in the tape width direction;

a cartridge installation portion in which the tape cartridge is installed;

a cutting portion that cuts off the tape-shaped member at a cut position outside the cartridge case;

a detection portion that detects passage of the respective detection target portions; and a feed portion that feeds the tape-shaped member based on the passage detection of the detection target portions corresponding to the label portions to separate the label portions at a prescribed cut spot on the tape-shaped member by the cutting portion, wherein the cartridge case has an exposed area, in which the respective detection target portions are exposed to be detected by the detection portion, on a feed path of the tape-shaped member, and a distance between the cut position and an upstream end of the exposed area is shorter than a distance between an end on a paying-out tip-end side of the detection target portion corresponding to any of the label portions and the cut spot of another of the label portions adjacent to the label portion concerned on the paying-out tip-end side in the tape feeding direction.

9. The tape feeding apparatus according to claim 8, wherein the cartridge case has a cover wall portion that covers an end surface on the one side of the tape-shaped member, the cover wall portion has a projection opening that causes the respective detection target portions to project to the one side, a tape cover portion that covers the respective passing detection target portions is provided at an upstream end in the tape feeding direction of the projection opening, and the exposed area is formed downstream of the tape cover portion in the tape feeding direction.

10. The tape feeding apparatus according to claim 9, wherein, in the tape width direction, an end on the one side of the tape cover portion is positioned closer to the other side than an end on the one side of the cover wall portion.

* * * * *